US005983880A

United States Patent [19]

Saunders

[11] Patent Number: 5,983,880

[45] Date of Patent: Nov. 16, 1999

[54] CABLE GUIDE

[76] Inventor: Charles A. Saunders, 8380 36th Ave., Columbus, Nebr. 68601

[21] Appl. No.: 09/090,359

[22] Filed: Jun. 4, 1998

[51] Int. Cl.[6] ..... F41B 5/10

[52] U.S. Cl. ..... 124/25.6

[58] Field of Search ..... 124/25.6, 86

[56] References Cited

U.S. PATENT DOCUMENTS

| | | | |
|---|---|---|---|
| 4,377,152 | 3/1983 | Saunders | 124/88 |
| 4,903,678 | 2/1990 | Walker | 124/90 |
| 4,917,070 | 4/1990 | Townsend | 124/25.6 X |
| 4,919,108 | 4/1990 | Larson | 124/25.6 X |
| 5,553,600 | 9/1996 | Miller | 124/86 |
| 5,651,355 | 7/1997 | Gallops | 124/25.6 |

OTHER PUBLICATIONS

Saunders Archery 1996 Catalog.

*Primary Examiner*—John A. Ricci

*Attorney, Agent, or Firm*—Koley, Jessen, Daubman & Rupiper, P.C.; Mark D. Frederiksen

[57] ABSTRACT

A cable guide includes a rod support member which is pivotally and slidably mounted on a cable guard rod on a compound bow, and a cable receiver member which is selectively connected and disconnected from the rod support member along an axis which is orthogonal to both the cable guard rod, and the cables of the bow. The rod support member includes a pair of spaced apart rearwardly projecting loops extending rearwardly from upper and lower walls. The receiver is designed to snap fit between the loops and the rearward edges of the upper and lower walls of the rod support member. A roller is rotatably mounted on an axle which extends vertically between the upper and lower walls of the rod support member, for rotatable engagement with the guard rod. The cable receiver member includes a lightweight body with a pair of spaced apart slots extending rearwardly from a forward face of the body. The slots will receive the cables of the bow. A pair of rollers are rotatably mounted on axles which are operably mounted within each of the slots of the receiver, such that the cables will engage the rollers and the receiver, as the cables extend through the slots and the receiver body.

25 Claims, 3 Drawing Sheets

CABLE GUIDE

TECHNICAL FIELD

The present invention relates generally to compound archery bows, and more particularly to an improved cable guide for shifting the cables of a compound bow away from the plane of the bowstring.

BACKGROUND OF THE INVENTION

Compound bows include pulleys at the free ends of the bow limbs and carry cables or strands to connect the opposite ends of the bowstring. Because the pulleys lie within the same spatial plane as the bowstring and arrow, the arrow shaft will contact the intermediate strands when the arrow is nocked on the bowstring. Such contact with the cable strands will interfere with the flight of the arrow upon release.

This has led to the use of a deflection rod or cable guard which extends from a midpoint on the bow and is laterally offset from the plane of the bow and bowstring, so as to offset the cables or strands laterally from the plane of the arrow, to provide a clear and unencumbered path for the arrow's flight.

Initial cable guards simply utilize a bent rod for deflecting the intermediate cables or strands. However, the frictional contact of the cables with the rod would reduce the "speed" of return of the bowstring, thereby reducing the potential velocity of the arrow during release. For this reason, cable guides have been attached to the cable guard rods for reducing friction between the cables and the rod. The majority of such prior art cable guides are formed of plastic members with two guide grooves therein, one for each cable. Such grooved cable guides were not entirely effective because of the frictional forces generated between the cables and the guide groove surfaces, as well as between the guide and the rod during the slight longitudinal movement of the guide on the rod.

In order to further reduce such frictional forces, the prior art discloses rollers provided in the cable guide grooves, as well as rollers or other bearings supporting the cable guide on the guide rod.

However, even these more recent advancements for cable guides suffer several drawbacks. First, all such cable guides require that the cables be pulled back around the free end of the cable guard rod, either prior to connection to the cable guide, or while connected to the cable guide. This requirement is both annoying and inconvenient when using the bow.

In addition, the prior art wheeled cable guides were "heavy" reducing the potential velocity of an arrow, as well as expensive to manufacture.

Finally, the prior art guides conventionally use open grooves to guide the cables, thereby potentially permitting the cables to become dislodged from the cable guide during release of the arrow.

SUMMARY OF THE INVENTION

It is therefore a general object of the present invention to provide an improved cable guide for archery bows.

A further object is to provide a cable guide which does not require that the cables be pulled rearwardly beyond the end of the cable guard rod.

Still another object of the present invention is to provide a cable guide which is lightweight, economical to manufacture, and refined in appearance.

Still a further object is to provide a cable guide which will not permit escape of the cables during release of an arrow, yet permits easy attachment and removal of the cable guide from the cables.

These and other objects of the present invention will be apparent to those skilled in the art.

The cable guide of the present invention includes a rod support member which is pivotally and slidably mounted on a cable guard rod on a compound bow, and a cable receiver member which is selectively connected and disconnected from the rod support member along an axis which is orthogonal to both the cable guard rod, and the cables of the bow. The rod support member includes a pair of spaced apart rearwardly projecting loops extending rearwardly from upper and lower walls. The receiver is designed to snap fit between the loops and the rearward edges of the upper and lower walls of the rod support member. A roller is rotatably mounted on an axle which extends vertically between the upper and lower walls of the rod support member, for rotatable engagement with the guard rod.

The cable receiver member includes a lightweight body with a pair of spaced apart slots extending rearwardly from a forward face of the body. The slots will receive the cables of the bow. A pair of rollers are rotatably mounted on axles which are operably mounted within each of the slots of the receiver, such that the cables will engage the rollers in the receiver, as the cables extend through the slots in the receiver body. Preferably, the rollers in the receiver body are mounted on axles which are offset both laterally and vertically within the receiver body.

DESCRIPTION OF THE PREFERRED EMBODIMENT

Figure 1:
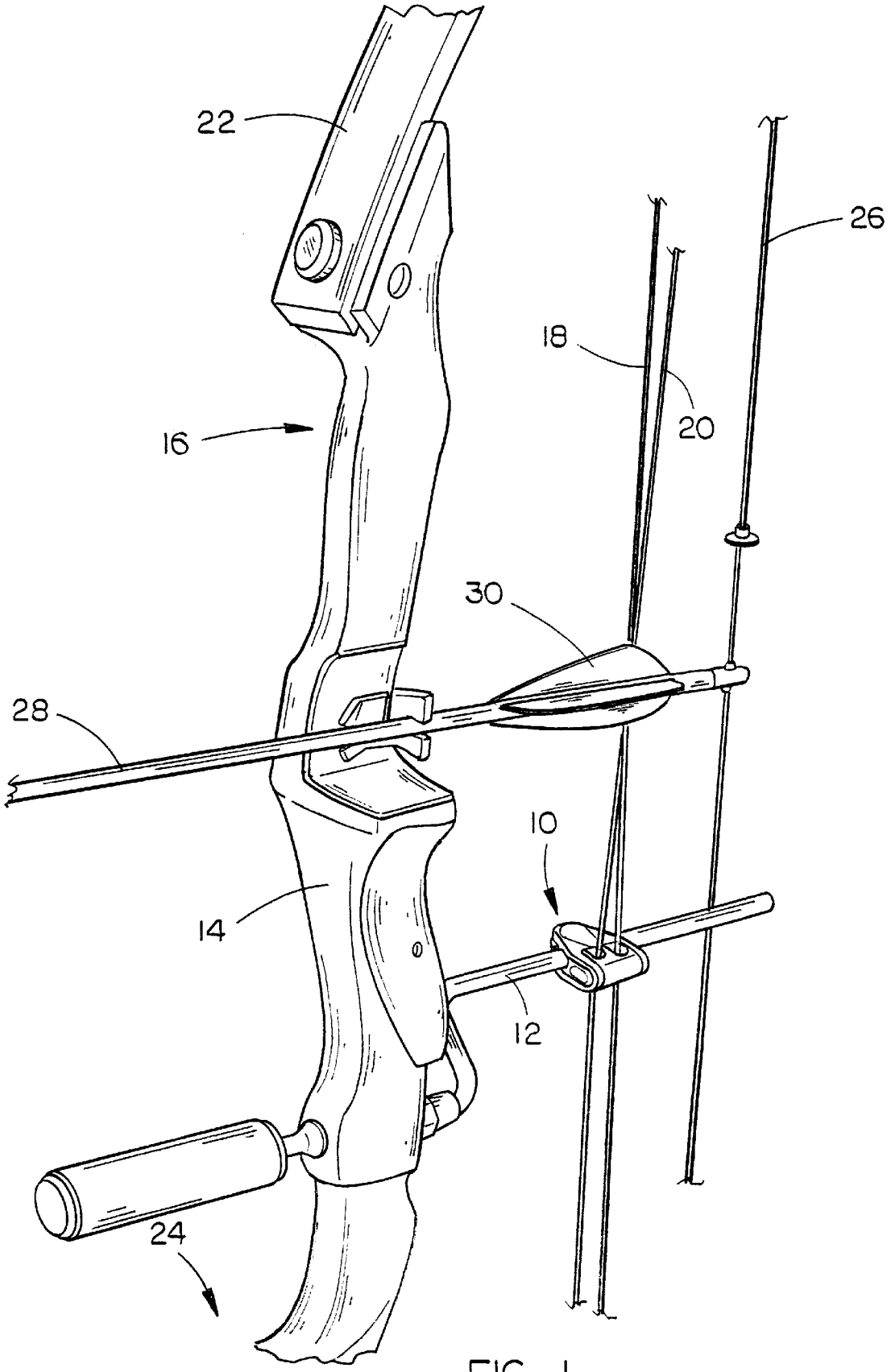
FIG. 1 is a perspective view of the cable guide shown mounted on a cable guard rod in use on a bow.

Referring now to the drawings, in which similar or corresponding parts are identified with the same reference numeral and more particularly to FIG. 1, the cable guide of the present invention is designated generally at 10, and is shown operably mounted on a cable guard rod 12 which projects rearwardly and laterally from the handle riser 14 of bow 16. Bow 16 is a conventional compound bow having a pair of cables 18 and 20 extending around pulleys (not shown) at the ends of the bow upper and lower limbs 22 and 24 (not shown), and connected to bowstring 26. Cable guide 10 will deflect cables 18 and 20 out of the spatial plane of the arrow 28 and bowstring 26, to prevent contact of the arrow fletching 30 with cables 18 and 20 upon release of the arrow.

Figure 3:
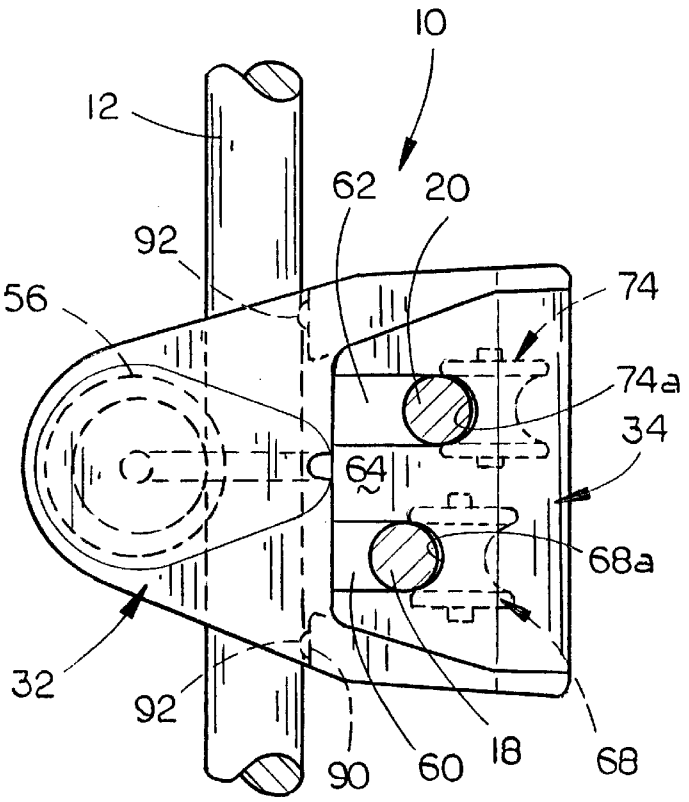
FIG. 3 is a top plan view of the cable guide in operational position.
Figure 2:
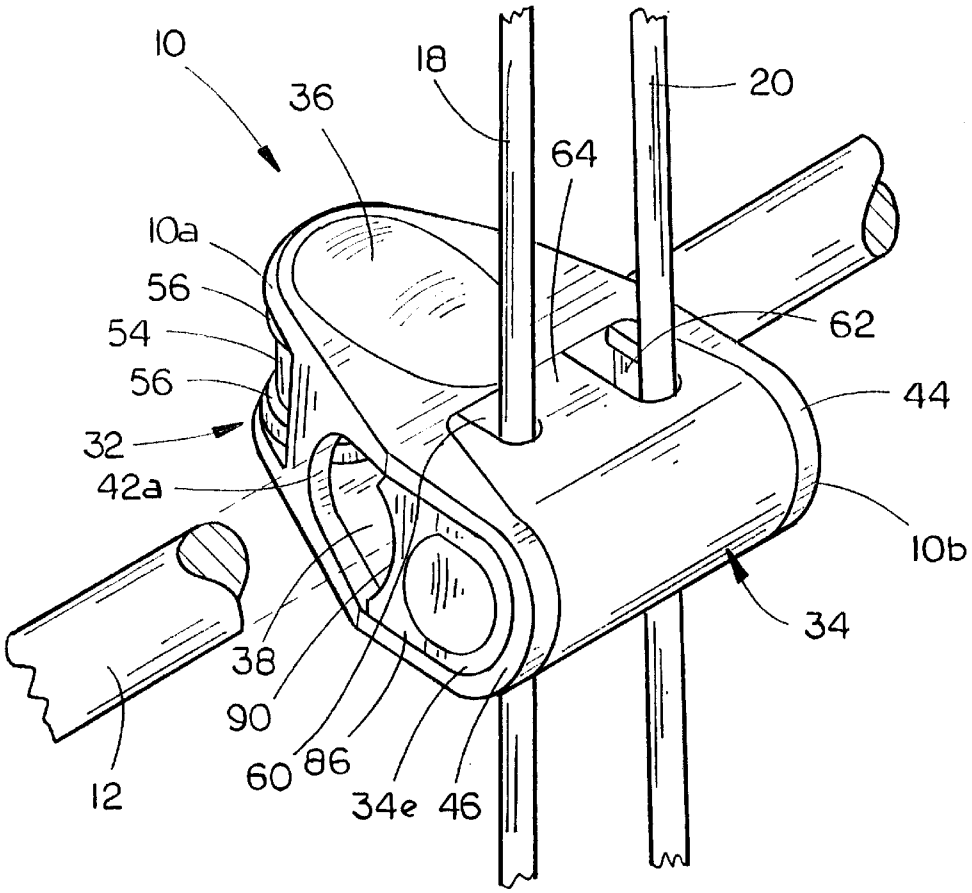
FIG. 2 is an enlarged perspective view of the cable guide in use.

Referring now to FIGS. 2 and 3, cable guide 10 includes a rod support member designated generally at 32 which is detachably connected to a cable receiver 34. Rod support member 32 connects the cable guide 10 to cable guard rod 12 and permits longitudinal movement of the guide along rod 12. For ease of description, cable guide 10 will be described as having a forward end 10*a*, rearward end 10*b*, upper end, lower end, and right and left sides. Thus, cables 18 and 20 extend vertically in an upper to lower direction, and are oriented rearwardly of rod 12, which extends horizontally in a transverse direction from side to side.

Figure 4:
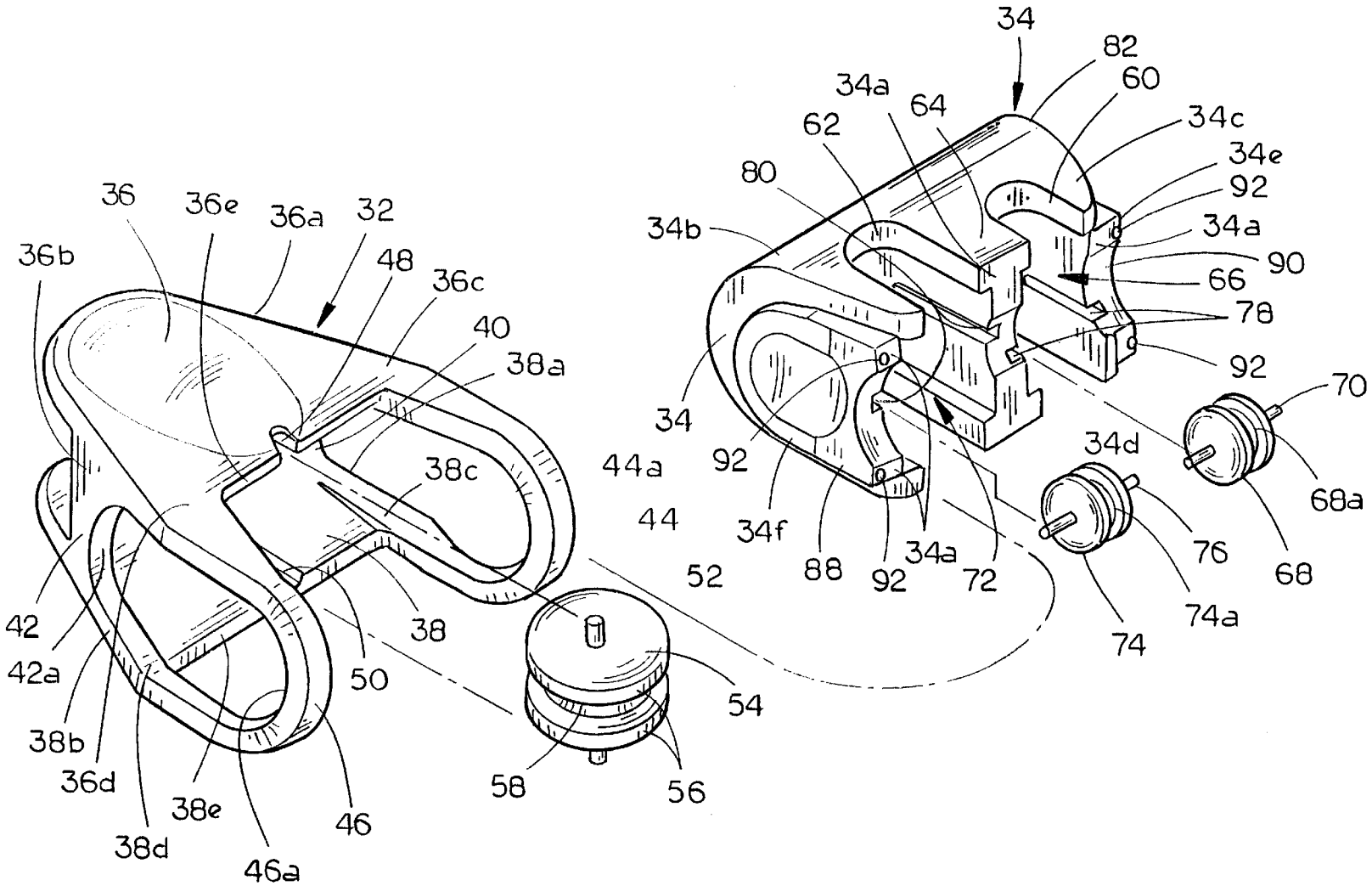
FIG. 4 is an exploded perspective view of the cable guide.

Referring now to FIG. 4, it can be seen that rod support member 32 includes an upper generally triangular wall 36 spaced apart and parallel to a lower generally triangular wall 38. The opposing side edges 36*a* and 36*b* of upper wall 36 are connected to the opposing side edges 38*a* and 38*b* of lower wall 38 by upstanding legs 40 and 42 respectively. The rearward corners 36*c* and 36*d* of upper wall 36 are connected to the rearward corners 38*c* and 38*d* respectively of lower wall 38 by rearwardly extending generally U-shaped loops 44 and 46 respectively. The inward arcuate surfaces 44*a* and 46*a* of loops 44 and 46 are curved to a radius slightly larger than the radius of rod 12, for a snug but slidable fit.

A pair of vertically aligned and opposing upper and lower grooves 48 and 50 extend forwardly from the rearward edges 36*e* and 38*e* of upper and lower walls 36 and 38. Grooves 48 and 50 extend forwardly less than the entire length of the lower surface of upper wall 36 and upper surface of lower wall 38, and have equal lengths. Grooves 48 and 50 receive axle 52 therebetween, which has a roller 54 rotatably mounted thereon. Preferably, the distance between grooves 48 and 50 decreases slightly from the rearward end to the forward end, such that axle 52 will slide easily forwardly from the rearward ends of the grooves to a tight fit at the forward ends of grooves 48 and 50.

Roller 54 is of a conventional variety having a pair of opposing circular coaxial flanges 56 connected by a generally cylindrical coaxial body 58, the body having a diameter less than the diameter of flanges 56. The distance between flanges 56 is less than the diameter of rod 12, such that flanges 56 will be in rolling contact with rod 12, as shown in FIGS. 2 and 3. Legs 40 and 42 have a curved rearward edge 42*a* having a radius slightly greater than the radius of rod 12, and positioned such that rod 12 will contact flanges 56 when support member 32 is connected to rod 12.

Cable receiver 34 is preferably formed of a solid piece of lightweight plastic having a forward face 34*a*, a cylindrical rearward face 34*b*, an upper face 34*c*, a lower face 34*d*, and opposing side faces 34*e* and 34*f*. Two vertical slots 60 and 62 are formed through the body of receiver 34, and extend parallel to one another rearwardly from the forward face 34*a*. Preferably, slot 62 extends rearwardly farther than slot 60, such that the slots have different depths, to retain cables 20 and 18 respectively at different lateral locations, as shown in FIGS. 2 and 3. A vertical central wall 64 separates slots 60 and 62, to maintain a separation of cables 18 and 20.

Referring once again to FIG. 4, a well 66 is formed in receiver 34 and extends rearwardly from the forward face 34*a*, for receiving a cable guide roller 68. Well 66 has a width extending between central wall 64 and right face 34*e*, and a length extending between the upper and lower faces 34*c* and 34*d*. Well 66 has a depth such that roller 68 will freely rotate on its axle 70 with the forward most tangential portion of the arcuate annular roller body 68*a* projecting slightly forwardly beyond the depth of slot 60, as shown in FIG. 3. In this way, cable 18 will contact roller 68 when journaled through slot 60.

A second well 72 is formed between central wall 64 and left face 34*f*, and upper and lower faces 34*c* and 34*d*, and extends rearwardly from forward face 34*a* to receive roller 74 therein. Well 72 has a depth greater than the depth of slot 62, such that the forward most tangent of the roller body 74*a* will project forwardly beyond the lower end of slot 62, as shown in FIG. 3. In this way, cable 20 will contact roller 74 when journaled through slot 62.

Rollers 68 and 74 are rotatably mounted on axles 70 and 76 respectively for free rotation when installed within wells 66 and 72 respectively. A pair of opposing grooves 78 are formed in the transverse side walls of well 66, and extend rearwardly from the forward face 34*a*, to receive the ends of axle 70. Preferably, the distance between grooves 78 decreases slightly from the forward end to the rearward end, such that the axle 70 will slide freely into the grooves at the forward end, but will have a tight press fit at the rearward end. A similar pair of opposing grooves 80 are formed in the lateral side walls of well 72 to receive the free ends of axle 76. As shown in FIG. 4, it is preferred that well 72 has a greater depth than well 66, so as to offset rollers 74 and 68 respectively between the forward and rearward surfaces 34*a* and 34*b* of receiver 34 (as shown more clearly in FIG. 3). In addition, grooves 78 are offset in a horizontal plane spaced vertically from the plane of grooves 80, as shown in FIG. 4, so that rollers 68 and 74 are also offset in the vertical direction within receiver 34. The offset rollers 68 and 74 assist in separating cables 18 and 20, to permit free movement of the cables without interference with one another.

Referring once again to FIG. 4, it can be seen that right face 34*e* and left face 34*f* have a generally U-shaped depressed shoulder 82 and 84 respectively, which correspond in shape to loops 46 and 44 respectively. Thus, loops 44 and 46 must be spread apart to receive receiver 34 therebetween. The length of loops 44 and 46 corresponds to the length (from the forward to the rearward faces) of receiver 34, such that forward face 34*a* will contact the rearward edges 36*e* and 38*e* of the support member upper and lower walls when loops 44 and 46 are positioned along the depressed shoulders 84 and 82 respectively. As shown in FIG. 2, receiver 34 will have a flush fit between loops 44 and 46 and upper and lower walls 36 and 38 when installed in support member 32.

In order to assist in the installation of receiver 34 into support member 32, a forward portion 86 (shown in FIG. 2) of right face 34*e* and a forward portion 88 (shown in FIG. 4) of left face 34*f*, are beveled. These beveled surfaces 86 and 88 will assist in forcing loops 44 and 46 outwardly as receiver 34 is pushed into the installed position within support member 32. When fully inserted, loops 44 and 46 will snap into a locked position against depressed shoulders 82 and 84 (as shown in FIGS. 2 and 3).

A generally cylindrical depression 90 is formed in the forward face 34*a* of receiver 34, as shown in FIG. 4. Depression 90 has a radius substantially the same as the radius of rod 12, to permit clearance of the surface of rod 12 when the rod is journaled between the support member 32 and receiver 34 as shown in FIGS. 2 and 3. Depression 90 is oriented from the right face 34*e* to the left face 34*f* and centered between the upper and lower faces 34*c* and 34*d*. Four pins 92 project forwardly from the forward face 34*a* on opposite sides of depression 90 and project a distance to contact and support the rod 12 spaced slightly away from depression 90, as shown in FIG. 3. Thus, rod 12 is journaled between roller 56 and pins 92. Because cables 18 and 20 are being pulled towards rod 12 by cable guide 10, the force of cables 18 and 20 will be directed rearwardly towards rollers 68 and 74, thereby biasing roller 56 of support member 32 against rod 12 and reducing any frictional contact of rod 12 on pins 92. Thus, in use, all frictional contact between rod 12, cable 18, and cable 20 with cable guide 10 will be with freely rotatable rollers 56, 68, and 74 respectively.

In use, the cable receiver 34 is removed from the rod support member 32, by pushing either loop 44 or 46 outwardly to increase the distance between the loops and release the cable receiver 34. It can be seen that cable receiver 34 is thereby disconnected in a direction which is orthogonal to both rod 12 and cables 18 and 20, as shown in FIG. 2. This is important, because it permits cables 18 and 20 to be inserted through slots 60 and 62, and then permits receiver 34 to be reconnected to the rod support member 32 without forcing the consumer to pull cables 18 and 20 beyond the free end of cable guard rod 12. Reconnecting receiver 34 to support member 32 merely requires pushing receiver 34 forwardly such that the beveled portions 86 and 88 on the receiver right and left sides 34*e* and 34*f* forcing loops 44 and 46 outwardly until the receiver 34 has moved forwardly into position. Loops 44 and 46 will then return to their original position in contact with shoulders 82 and 84, and retaining receiver 34 in position.

Whereas the invention has been shown and described in connection with the preferred embodiment thereof, many modifications, substitutions and additions may be made which are within the intended broad scope of the appended claims.

I claim:

1. A cable guide for attachment to a compound bow having a bowstring, a pair of cables connected to ends of the bowstring and extending around pulleys to opposing ends of upper and lower limbs of the bow, and a cable guard rod extending towards the bowstring from a central handle riser and laterally offset from a plane formed by the handle riser, limbs and bowstring, the cable guide comprising:

a rod support member having means for operably connecting the support member to the guard rod for pivotable movement about a longitudinal axis of the rod and for slidable movement forwardly and rearwardly along the longitudinal axis of the rod;

means for removably connecting the rod support member to a cable receiver; and a cable receiver including means for receiving the bow cables and for deflecting the bow cables laterally relative to the plane of the bow and bowstring.

2. The cable guide of claim 1, wherein said cable receiver includes a lightweight body having forward and rearward surfaces, upper and lower faces and opposing side faces, and further includes a pair of spaced apart first and second slots extending vertically from the upper to the lower surfaces and extending rearwardly from the forward surface less than the entire distance to the rearward surface, for receiving said cables therethrough.

3. The cable guide of claim 2, wherein said first and second slots have depths, measured from the body forward edge to a rearward extent of each slot, and wherein the first slot has a depth greater than the second slot.

4. A cable guide for attachment to a compound bow having a bowstring, a pair of cables connected to ends of the bowstring in and extending around pulleys to opposing ends of upper and lower limbs of the bow, and a cable guard rod extending towards the bowstring from a central handle riser and laterally offset from a plane formed by the handle riser, limbs and bowstring, the cable guide comprising:

a rod support member having means for operably connecting the support member to the guard rod for pivotable movement about a longitudinal axis of the rod and for slidable movement forwardly and rearwardly along the longitudinal axis of the rod;

means for removably connecting the rod support member to a cable receiver adapted to permit connection and disconnection of the rod support member and cable receiver along an axis orthogonal to both the axis of the guard rod and the axes of the cables; and a cable receiver including means for receiving the bow cables and for deflecting the bow cables laterally relative to the plane of the bow and bowstring.

5. The cable guide of claim 4, wherein said rod support member includes:

spaced apart and parallel upper and lower walls with forward and rearward edges and opposing side edges;

at least one leg connected between the upper and lower walls; and a pair of rearwardly extending, spaced apart U-shaped loops connected between the upper and lower walls;

wherein said cable receiver is adapted for a snap fit between the rearward edges of the upper and lower walls and the loops.

6. The cable guide of claim 5, further comprising a roller rotatably mounted on an axle, the axle mounted in a vertical orientation between the upper and lower walls, and orthogonal to the longitudinal axis of the rod, and the roller having an exterior rolling surface for guiding engagement with the rod.

7. The cable guide of claim 6, wherein said support member upper wall includes an upper groove formed in a lower surface thereof, extending forwardly from the rearward edge;

wherein the lower wall includes a lower groove formed in an upper surface thereof, extending forwardly from the rearward edge;

said upper and lower grooves being equal in length and vertically aligned; and wherein said axle includes opposing upper and lower ends engaged within the upper and lower grooves respectively.

8. The cable guide of claim 7 wherein said support member upper and lower grooves are spaced apart a distance at rearward ends which is greater than a length of the roller axle, and spaced apart a distance at forward ends which is less than the length of the roller axle, the distance between the grooves gradually decreasing from the rearward ends to the forward ends.

9. The cable guide of claim 8, wherein said cable receiver includes a lightweight body having forward and rearward surfaces, upper and lower faces and opposing side faces, and further includes a pair of spaced apart first and second slots extending vertically from the upper to the lower surfaces and extending rearwardly from the forward surface less than the entire distance to the rearward surface, for receiving said cables therethrough.

10. The cable guide of claim 9, wherein each of said first and second slots includes opposing inner and outer side walls, the inner side walls of the slots forming a central wall in the receiver body, and further comprising:

a first roller rotatably mounted on a first axle, the first axle mounted between the first slot side walls and oriented generally parallel to the rod, said first roller having an exterior surface adapted for guiding engagement with a cable; and a second roller rotatably mounted on a second axle, the second axle mounted between the second slot side walls and oriented generally parallel to the first axle, said second roller having an exterior surface adapted for guiding engagement with a cable.

11. The cable guide of claim 10, wherein said first and second slots have depths, measured from the body forward edge to a rearward extent of each slot, and wherein the first slot has a depth greater than the second slot.

12. The cable guide of claim 11, wherein the receiver first axle has an axis parallel to but offset rearwardly relative to the second axle, to thereby offset the depths of cables engaging the first and second rollers in the receiver.

13. The cable guide of claim 12, wherein the receiver first axle is oriented in a horizontal plane which is vertically offset from a horizontal plane in which the receiver second axle is oriented, to thereby vertically offset the first and second rollers in the receiver.

14. The cable guide of claim 13, further comprising:

a first pair of opposing grooves in the first slot side walls, extending rearwardly into the slot from the forward surface of the receiver body; and a second pair of opposing grooves formed in the second slot side walls, extending rearwardly into the slot from the forward surface of the receiver body.

15. The cable guide of claim 14, wherein:

the receiver first pair of grooves are spaced apart a distance at rearward ends which is greater than a length of the first axle, and spaced apart a distance at forward ends which is less than the length of the first axle, the distance between the grooves gradually decreasing from the rearward ends to the forward end;

the receiver second pair of grooves are spaced apart a distance at rearward ends which is greater than a length of the second axle, and spaced apart a distance at forward ends which is less than the length of the second axle, the distance between the grooves gradually decreasing from the rearward ends to the forward ends.

16. A cable guide for attachment to a compound bow having a bowstring, a pair of cables connected to ends of the bowstring in and extending around pulleys to opposing ends of upper and lower limbs of the bow, and a cable guard rod extending towards the bowstring from a central handle riser and laterally offset from a plane formed by the handle riser, limbs and bowstring, the cable guide comprising:

a rod support member having means for operably connecting the support member to the guard rod for pivotable movement about a longitudinal axis of the rod and for slidable movement forwardly and rearwardly along the longitudinal axis of the rod;

said rod support member including:

spaced apart and parallel upper and lower walls with forward and rearward edges and opposing side edges;

at least one leg connected between the upper and lower walls; and a pair of rearwardly extending, spaced apart U-shaped loops connected between the upper and lower walls;

means for removably connecting the rod support member to a cable receiver; and a cable receiver including means for receiving the bow cables and for deflecting the bow cables laterally relative to the plane of the bow and bowstring;

said cable receiver adapted for a snap fit between the rearward edges of the upper and lower walls and the loops.

17. The cable guide of claim 16, further comprising a roller rotatably mounted on an axle, the axle mounted in a vertical orientation between the upper and lower walls, and orthogonal to the longitudinal axis of the rod, and the roller having an exterior rolling surface for guiding engagement with the rod.

18. The cable guide of claim 17, wherein said support member upper wall includes an upper groove formed in a lower surface thereof, extending forwardly from the rearward edge;

wherein the lower wall includes a lower groove formed in an upper surface thereof, extending forwardly from the rearward edge;

said upper and lower grooves being equal in length and vertically aligned; and wherein said axle includes opposing upper and lower ends engaged within the upper and lower grooves respectively.

19. The cable guide of claim 18, wherein said support member upper and lower grooves are spaced apart a distance at rearward ends which is greater than a length of the roller axle, and spaced apart a distance at forward ends which is less than the length of the roller axle, the distance between the grooves gradually decreasing from the rearward ends to the forward ends.

20. A cable guide for attachment to a compound bow having a bowstring, a pair of cables connected to ends of the bowstring in and extending around pulleys to opposing ends of upper and lower limbs of the bow, and a cable guard rod extending towards the bowstring from a central handle riser and laterally offset from a plane formed by the handle riser, limbs and bowstring, the cable guide comprising:

a rod support member having means for operably connecting the support member to the guard rod for pivotable movement about a longitudinal axis of the rod and for slidable movement forwardly and rearwardly along the longitudinal axis of the rod;

means for removably connecting the rod support member to a cable receiver; and a cable receiver including means for receiving the bow cables and for deflecting the bow cables laterally relative to the plane of the bow and bowstring;

said cable receiver including:

a lightweight body having forward and rearward surfaces, upper and lower faces and opposing side faces; and a pair of spaced apart first and second slots extending vertically from the upper to the lower surfaces and extending rearwardly from the forward surface less than the entire distance the rearward surface, for receiving said cables therethrough;

each of said first and second slots including opposing inner and outer side walls, the inner side walls of the slots forming a central wall in the receiver body;

a first roller rotatably mounted on a first axle, the first axle mounted between the first slot side walls and oriented generally parallel to the rod, said first roller having an exterior surface adapted for guiding engagement with a cable; and a second roller rotatably mounted on a second axle, the second axle mounted between the second roller having an exterior surface adapted for guiding engagement with a cable.

21. The cable guide of claim 20, wherein said first and second slots have depths, measured from the body forward edge to a rearward extent of each slot, and wherein the first slot has a depth greater than the second slot.

22. The cable guide of claim 20, wherein the receiver first axle has an axis parallel to but offset rearwardly relative to the second axle, to thereby offset the depths of cables engaging the first and second rollers in the receiver.

23. The cable guide of claim 20, wherein the receiver first axle is oriented in a horizontal plane which is vertically offset from a horizontal plane in which the receiver second axle is oriented, to thereby vertically offset the first and second rollers in the receiver.

24. The cable guide of claim 20, further comprising:

a first pair of opposing grooves in the first slot side walls, extending rearwardly into the slot from the forward surface of the receiver body; and a second pair of opposing grooves formed in the second slot side walls, extending rearwardly into the slot from the forward surface of the receiver body.

25. The cable guide of claim 24, wherein:

the receiver first pair of grooves are spaced apart a distance at rearward ends which is greater than a length of the first axle, and spaced apart a distance at forward ends which is less than the length of the first axle, the distance between the grooves gradually decreasing from the rearward ends to the forward end;

the receiver second pair of grooves are spaced apart a distance at rearward ends which is greater than a length of the second axle, and spaced apart a distance at forward ends which is less than the length of the second axle, the distance between the grooves gradually decreasing from the rearward ends to the forward ends.

* * * * *